US005277464A

United States Patent [19]

Okun

[11] Patent Number: 5,277,464

[45] Date of Patent: Jan. 11, 1994

[54] CHOPSTICKS

[76] Inventor: Milton R. Okun, 168 Neponset St., Apr. 6, Canton, Mass. 02021

[21] Appl. No.: 880,534

[22] Filed: May 8, 1992

[51] Int. Cl.[5] ..... A47G 21/10

[52] U.S. Cl. ..... 294/1.1; 294/5.5

[58] Field of Search ..... 294/1.1, 5, 5.5, 23.5, 294/25, 33, 99.2; 16/110 R; 16/111 R; 16/116 R; 16/DIGS. 12, 19; 30/142, 298, 322, 324, 327, 340; 74/551.9; 273/81 R; 273/81.4; 401/6, 7, D7/642

[56] References Cited

U.S. PATENT DOCUMENTS

| | | | |
|---|---|---|---|
| 412,479 | 10/1889 | Davis | 30/340 X |
| 624,722 | 5/1899 | Allen | 294/99.2 X |
| 2,263,885 | 11/1941 | McGauley | 16/111 R X |
| 2,650,426 | 9/1953 | Montelius | 30/340 X |
| 2,670,234 | 2/1954 | Roop | 294/99.2 |
| 3,224,093 | 12/1965 | Huck | 30/324 |
| 4,592,109 | 6/1986 | Borea et al. | 16/111 R X |

FOREIGN PATENT DOCUMENTS

| | | | |
|---|---|---|---|
| 359100 | 9/1922 | Fed. Rep. of Germany | 30/340 |
| 910205 | 4/1954 | Fed. Rep. of Germany | 30/340 |
| 15234 | 4/1971 | Japan | 294/1.1 |
| 3-170114 | 7/1991 | Japan | 294/1.1 |
| 2065454 | 7/1981 | United Kingdom | 294/25 |
| 2234425 | 2/1991 | United Kingdom | 294/1.1 |

*Primary Examiner*—Johnny D. Cherry
*Attorney, Agent, or Firm*—Wolf, Greenfield & Sacks

[57] ABSTRACT

A chopstick eating utensil comprising an elongated member having a defined outer perimeter, a selected length, a top end, a bottom food handling end, and a finger grooved region between the top and bottom ends; the finger grooved region comprising a first upper medial groove formed within the perimeter of the member and dimensioned to receiving a thumb of a hand and a second lower lateral groove for receiving another finger of the hand, the lower lateral groove being formed within the perimeter of the elongated member laterally opposing the medial groove and being disposed below the medial groove closer along the length of the member to the bottom end than the medial groove is disposed.

6 Claims, 6 Drawing Sheets

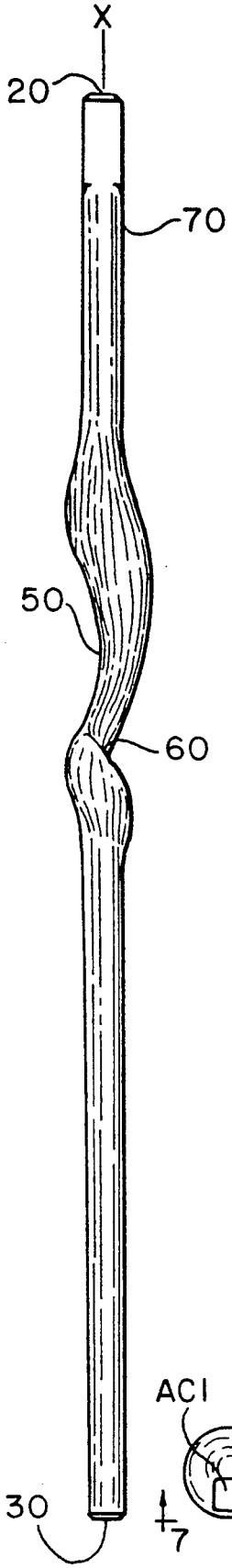
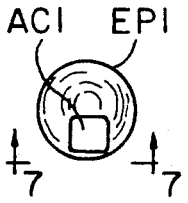
FIG.7 FIG.7a
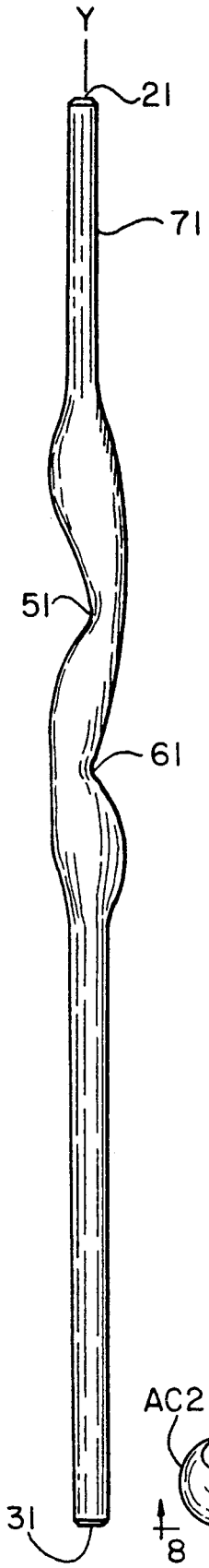
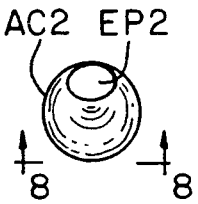
FIG.8 FIG.8a

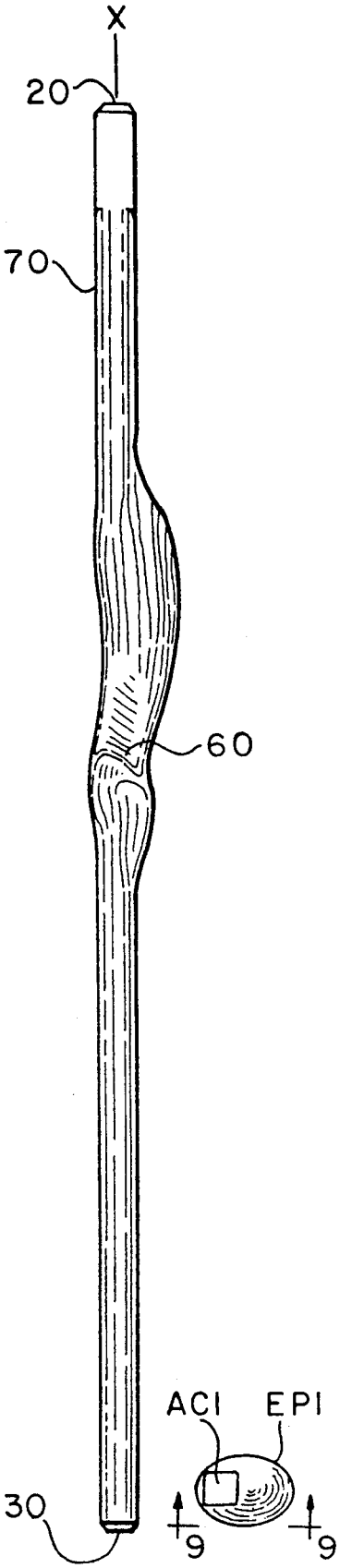
FIG.9 FIG.9a
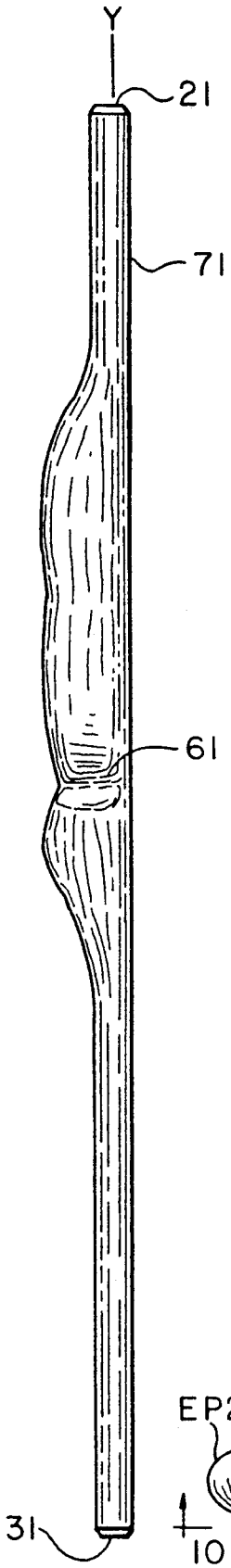
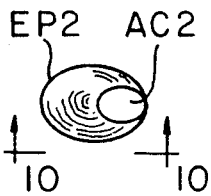
FIG.10 FIG.10a

CHOPSTICKS

BACKGROUND OF THE INVENTION

The present invention relates to eating utensils and more particularly to chopsticks having a mechanism for readily accommodating fingers in a gripping position of a chopstick.

SUMMARY OF THE INVENTION

In accordance with the invention, there is provided an elongated chopstick having a generally central axis extending from a first food gripping end to a second upper end, the chopstick having a defined outer perimeter, the perimeter being interrupted by at least two generally parallel grooves on opposed sides of the perimeter, the grooves being spaced a distance apart along the axis, the distance being selected to provide for ease of gripping by at least a thumb and another finger of the hand of the user. The grooves are so configured as to conform to an optimal finger gripping position for chopstick use.

A chopstick according to the invention typically has a selected length, a top end, a bottom food handling end, and a finger grooved region between the top and bottom ends; the finger grooved region comprising a first upper medial groove is formed within the perimeter of the member and dimensioned to receiving at least a thumb of a hand and a second lower lateral groove for receiving another finger of the hand, the lower lateral groove being formed within the perimeter of the elongated member laterally opposing the medial groove and being disposed below the medial groove closer along the length of the member to the bottom end of the chopstick than the medial groove is disposed.

A pair of chopsticks eating utensils is also provided wherein each of the chopsticks comprises an elongated member having a generally central axis extending from a first bottom food gripping end to a second upper end; the elongated member having a groove formed within the member between the upper and lower ends for receiving a finger of a hand of a user and enhancing gripping of the elongated member.

A chopstick may include one or more grooves in addition to an upper medial and lower lateral groove for receiving one or more additional fingers and further facilitating gripping of the chopstick.

Preferably, where a pair of chopsticks eating utensils is provided, each of the chopsticks comprises an elongated tubular member having a selected length, a top end, a bottom food handling end, and a finger grooved region between the top and bottom ends; the finger grooved region of each elongated member comprising a first upper medial groove is formed within the surface of the member for receiving a thumb and a second lower lateral groove is formed for receiving another finger. The lower lateral groove is formed within the surface of the member laterally opposing the medial groove and is disposed below the medial groove closer along the length of the member to the bottom end than the medial groove is disposed. In one embodiment, the medial groove of one of the pair of chopsticks is disposed a distance along the length of the one chopstick which is nearer to the bottom end of the one chopstick than the distance between the medial groove of the other chopstick and the end of the other chopstick.

The minimum of two grooves on each of a pair of chopsticks are preferably disposed on opposing surfaces of each of the chopsticks.

A chopstick according to the invention typically comprises a generally straight tubular member.

A tubular member typically comprises a straight elongated tube, totally or partially solid or hollow, the grooves being formed as recesses within regions of expanded thickness incorporated along the length of the tubular member.

The groove typically have an abrupt distal end and a gradual sloping proximal end.

Further, in accordance with the invention, there is provided a method of enhancing gripping of a chopstick for use in eating. The method comprises: forming a first medial groove in an elongated chopstick having a food gripping end at a prescribed distance from the end of the chopstick to receive the thumb of a hand, forming a second lateral groove in the chopstick at a distance closer to the food gripping end to receive another finger of the hand whereby the chopstick may be firmly gripped by a user in an eating procedure

BRIEF DESCRIPTION OF THE FIGURES

Representative embodiments of the invention are shown and described with reference to the drawings wherein:

FIGS. 7 and 8 are posterior views of the chopsticks of FIGS. 3 and 4 respectively; and FIGS. 7*a* and 8*a* are bottom end views of the FIGS. 7 and 8 views respectively;

FIGS. 9 and 10 are rear or lateral views of the chopsticks of FIGS. 3 and 4 respectively showing lower forefinger and middle finger gripping accommodation grooves respectively from a head-on perspective.

FIGS. 9*a* and 10*a* are bottom end views of the FIGS. 9 and 10 views respectively.

DETAILED DESCRIPTION OF THE INVENTION

Figure 1:
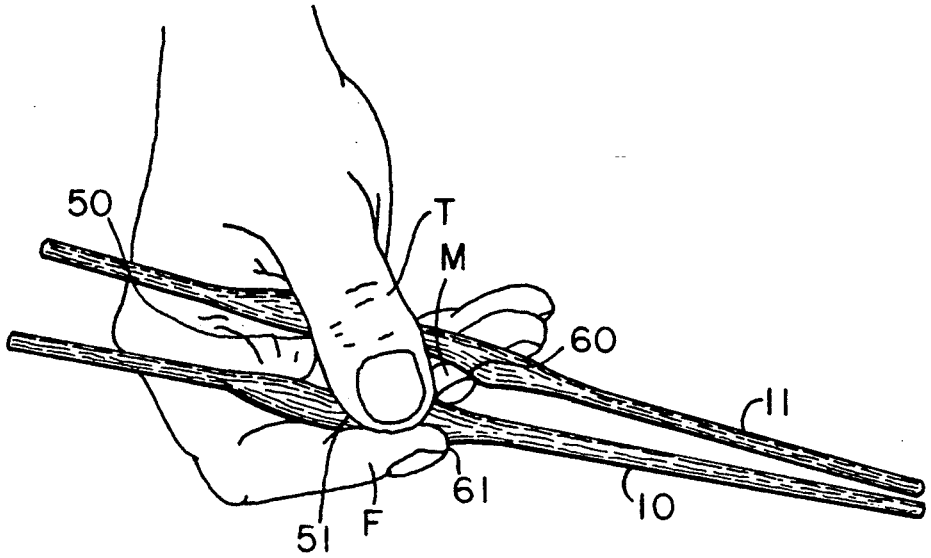
FIGS. 1 and 2 are perspective medial and lateral views respectively of a human hand grasping a pair of chopsticks having gripping accommodation grooves according to the invention.

A chopstick 10 according to the invention is shown in FIGS. 3–10. The chopstick 10 has a top end 20 and a bottom food handling or grasping end 30. Between the two ends 20, 30 there is a grooved region 40. As shown in FIGS. 3, 5, 7 and 9, the grooved region 40 of the chopstick 10 has an upper groove 50 and a lower groove 60. Shown in FIGS. 4, 6, 8 and 10 is another chopstick 11 according to the invention having a top end 21, bottom end 31, and intermediate grooved region 41, having an upper groove 51 and lower groove 61.

Figure 2:
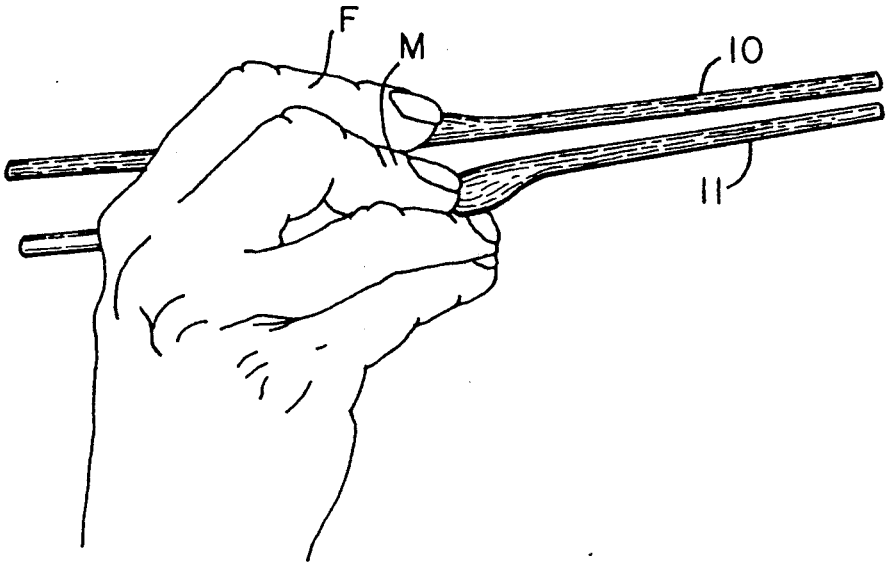
Figures 3, 3A:
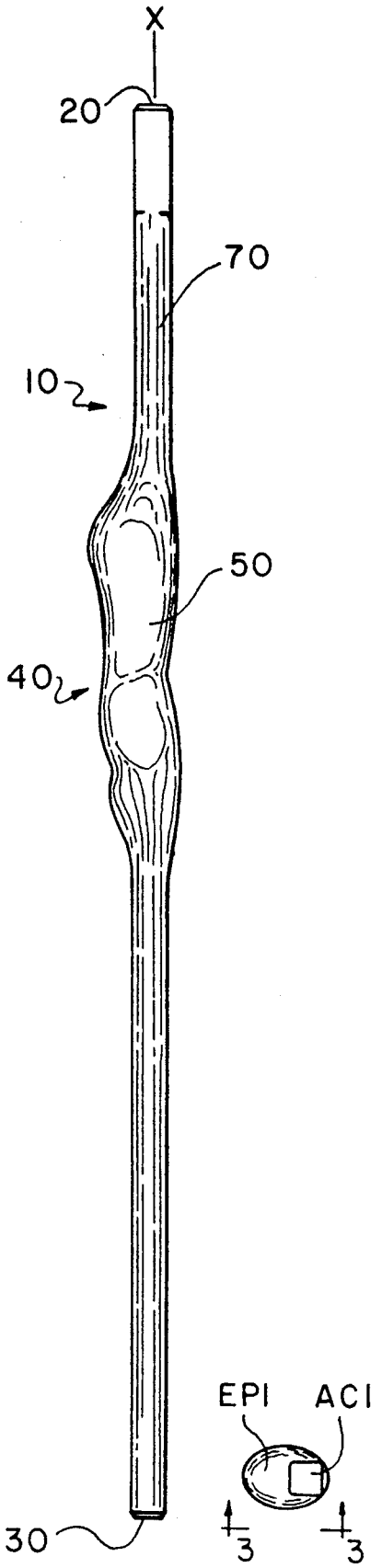
FIGS. 3 and 4 are front or medial views of a pair of chopsticks showing upper thumb receiving grooves formed within the perimeter of the chopsticks from a head-on perspective.
FIGS. 3*a* and 4*a* are bottom end views of the FIGS. 3 and 4 views respectively.
Figures 4, 4A:
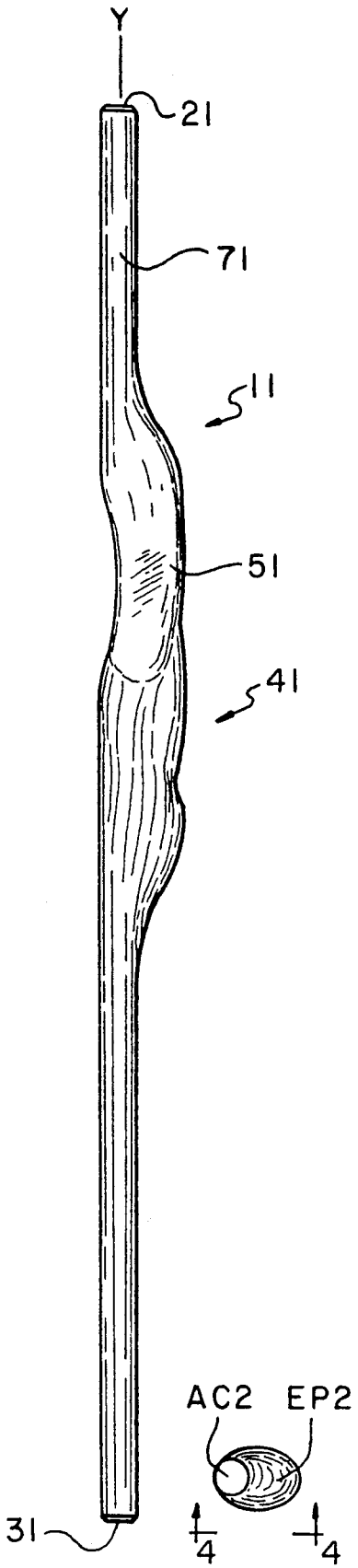
Figures 5, 5A:
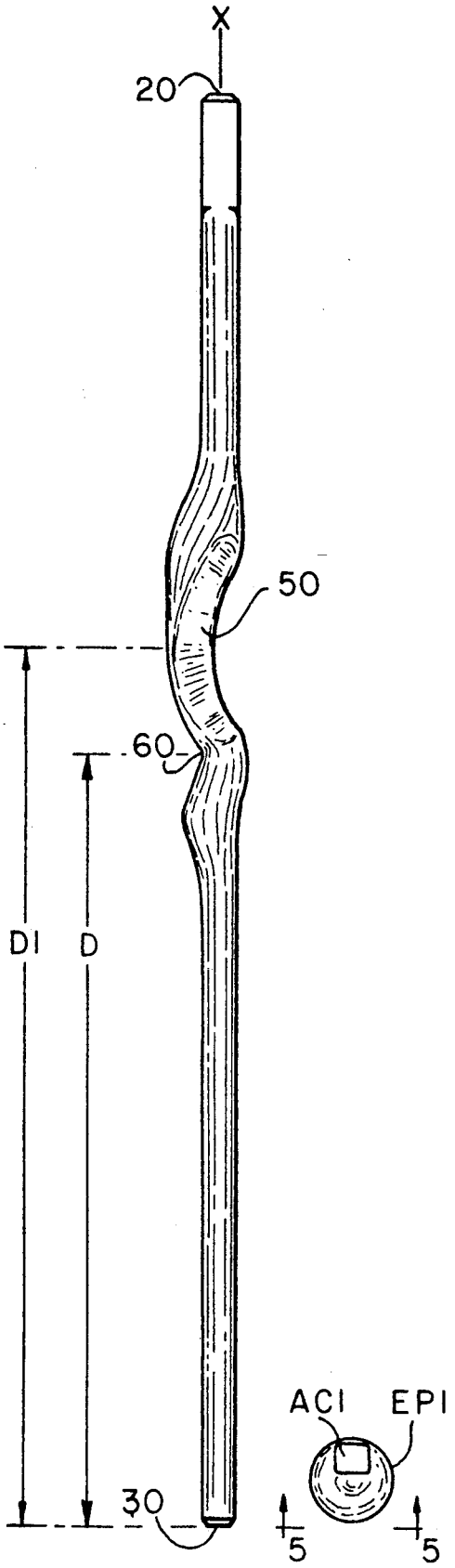
FIGS. 5 and 6 are anterior views of the chopsticks of the FIGS. 3 and 4 respectively.
FIGS. 5*a* and 6*a* are bottom line end views of the FIGS. 5 and 6 views respectively.
Figures 6, 6A:
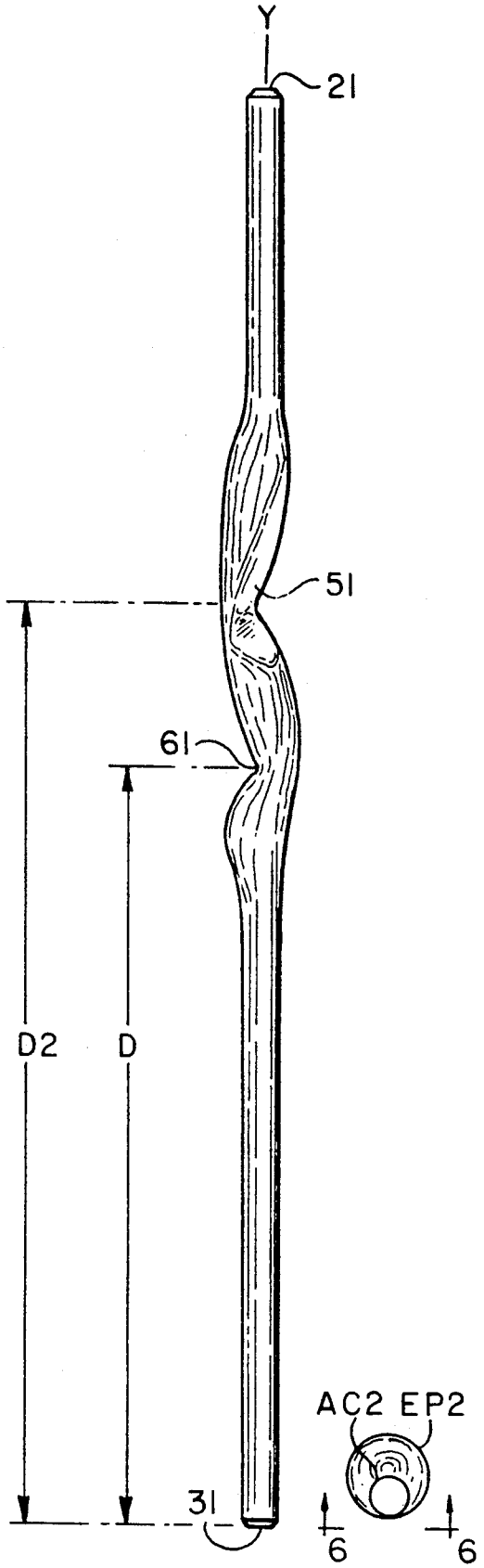

The two chopsticks 10, 11 may be used as a pair as shown in FIGS. 1, 2 for right handed use. For left handed use, the chopsticks shown in FIGS. 1–10 are constructed as a mirror image transformation of the chopsticks shown in FIGS. 1-10.

Each chopstick 10, 11 comprises an elongated generally tubular member 70, 71 which is expanded in the grooved regions 40, 41. By "tubular" is meant that the members 70, 71 are generally straight elongated members, except within the grooved regions 40, 41 having generally straight central axes X, Y. The elongated members 70, 71 may be solid throughout or hollow throughout or partially solid and partially hollow throughout their lengths from top 20, 21 to bottom 30, 31.

In cross-section in a plane perpendicular to their axes X, Y, outside the grooved regions, 40, 41, the members 70, 71 may have essentially any configuration on their outside perimeter, e.g., circular, square, hexagonal, octagonal, or the like.

In the grooved region 40, 41, the members 70, 71 are expanded and configured to accommodate formation of medial grooves 50, 51 and lateral grooves 60, 61. The expanded regions 40, 41 are configured in a generally bulbous manner as shown in the figures whereby the grooves 50, 51 and 60, 61 may be formed so as to readily accommodate receipt of a human finger in an optimal finger gripping position for chopsticks use. As shown in FIGS. 3-10, the grooves have a modified V-shape having an upper portion forming a first angle relative to the longitudinal axis of a chopstick and a lower portion forming a steeper angle than the first angle relative to the longitudinal axis.

As shown in the bottom plan views in each of FIGS. 3-10, the configuration and orientation of the expanded portion EP1 of one 10 of the pair of chopsticks is different from the configuration and orientation of the expanded portion EP2 of the other 11 of the pair of chopsticks. The difference in the expanded portion configurations EP1 and EP2 are selected so as to provide optimal finger gripping positioning and receipt within grooves 50, 60, 51, 61. For purposes of illustration only, the configuration of the chopstick members 70, 71 in cross-section perpendicular to axes X, Y (outside the grooved region 40, 41) is shown as square AC1 and circular AC2, respectively.

As shown in FIGS. 1, 2, the medial grooves 50, 51 are typically configured to receive a thumb T, the lateral groove 60 is configured to receive another finger such as an index or forefinger F and the lateral groove 61 is configured to receive another finger such as a middle finger M.

As can be readily imagined from the figures, the members 70, 71 are typically uniform in perpendicular cross-section outside the grooved regions 40, 41 and non-uniform in cross-section in the bulbous or expanded grooved regions.

An upper medial groove 50 or 51 is formed on one surface of a member 70, 71 and a lower lateral groove 60 or 61 is formed on a surface laterally opposing the medial groove 50 or 51. That is, the upper and lower grooves oppose each other such that two separate fingers may be separately received within the two opposing grooves 50, 60 or 51, 61 and the fingers may readily effect a firm grasp on the members 70, 71 as shown for example, in FIGS. 1, 2.

At least one chopstick is provided according to the invention having an upper groove configured to receive a thumb and a lower groove configured to receive an index finger.

In an embodiment where a pair of chopsticks 10 and 11 are provided, the upper grooves 50, 51 are configured to receive a thumb and the lower groove 60 of one chopstick 10 of a pair is configured to receive an index finger and the lower groove 61 of the other chopstick 11 of a pair is configured to receive a middle finger.

A chopstick according to the invention may also be provided with one or more grooves in addition to the two opposing grooves for accommodating additional fingers.

In the embodiments shown in FIGS. 3-10, where a pair of chopsticks 10, 11 are provided, the upper groove 50 of one chopstick 10 of the pair is disposed a slightly shorter distance $D_1$ from the bottom end 30 than the distance $D_2$ from the bottom end 31 at which the upper groove 51 of the other chopstick 11 of the pair is disposed. The difference between $D_1$ and $D_2$ is typically between about 0.1-0.5 inches. The difference in distances $D_1$ and $D_2$ enables a user of the chopsticks 10, 11 to place a thumb in the two grooves 50, 51, an index finger in groove 60, a middle finger in groove 61 and have the bottom ends 30, 31 of the two chopsticks 10, 11 longitudinally aligned with each other without undue manipulation by the hand of the user.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A pair of chopsticks eating utensils, each of said chopsticks comprising:

an elongated tubular member having a selected length along a longitudinal axis, a top end, a bottom food handling end, and a finger grooved region between the top and bottom ends;

the finger grooved region of each elongated member comprising a first upper medial groove formed within the surface of the member for receiving a thumb and a second lower lateral groove for receiving another finger, the lower lateral groove being formed within the surface of the member laterally opposing the medial groove and being disposed below the medial groove closer along the length of the member to the bottom end than the medial groove is disposed; wherein the grooves have a modified V-shape having an upper portion forming a first angle with the longitudinal axis of the elongated member and a lower portion forming a steeper angle than the first angle with the longitudinal axis.

2. The chopsticks of claim 1 wherein the lower lateral groove of each chopstick is disposed about the same distance from the bottom end of each chopstick.

3. The chopsticks of claim 2 wherein the grooves are formed in regions of expanded thickness along the length of the elongated member.

4. The chopsticks of claim 1 wherein the grooves are formed in regions of expanded thickness along the length of the elongated member.

5. A chopstick comprising:

an elongated tubular member having a selected length along a longitudinal axis, a top end, a bottom food handling end and a finger grooved region between the top and bottom ends;

the finger grooved region comprising a first upper medial groove for receiving one finger of a hand and a second lower lateral groove for receiving a second finger, the grooves being formed within opposing surfaces of the member, the lateral groove being disposed closer to the bottom end along the longitudinal axis than the medial groove is disposed;

the grooves having a modified V-shape having an upper portion forming a first angle relative to the longitudinal axis and a lower portion forming a steeper angle than the first angle relative to the longitudinal axis.

6. The chopstick of claim 5 wherein the grooves are formed within regions of expanded thickness which align the grooves for proper finger gripping.

* * * * *